252-148 AU 166 EX
6/12/79 XR 4,157,977

United States Patent [19]
Dewar et al.

[11] 4,157,977
[45] * Jun. 12, 1979

[54] DETERGENT-GERMICIDE COMPOSITIONS

[75] Inventors: Norman E. Dewar; Said I. Razig, both of St. Louis, Mo.

[73] Assignee: Chemed Corporation, Cincinnati, Ohio

[ * ] Notice: The portion of the term of this patent subsequent to Nov. 3, 1987, has been disclaimed.

[21] Appl. No.: 735,995

[22] Filed: Oct. 27, 1976

Related U.S. Application Data

[63] Continuation-in-part of Ser. No. 630,868, Nov. 11, 1975, abandoned, which is a continuation of Ser. No. 485,184, Jul. 2, 1974, abandoned, which is a continuation of Ser. No. 11,328, Feb. 13, 1970, abandoned.

[51] Int. Cl.[2] ..... C11D 3/48; C11D 7/08
[52] U.S. Cl. ..... 252/106; 252/142; 252/143; 252/148; 252/153; 252/551
[58] Field of Search ..... 252/106, 107, 551, 142, 252/143, 148, 153; 424/346, 347

[56] References Cited

U.S. PATENT DOCUMENTS

| | | | |
|---|---|---|---|
| 3,160,555 | 12/1964 | Hamill et al. | 424/346 |
| 3,496,271 | 2/1970 | Röhner | 424/213 |
| 3,538,217 | 11/1970 | Dewar et al. | 424/173 |
| 3,650,964 | 3/1972 | Sedliar et al. | 252/106 |
| 3,824,190 | 7/1974 | Winicov et al. | 252/106 |

FOREIGN PATENT DOCUMENTS

| | | |
|---|---|---|
| 743984 | 1/1956 | United Kingdom. |
| 1040543 | 9/1966 | United Kingdom. |
| 1104692 | 2/1968 | United Kingdom. |

OTHER PUBLICATIONS

Putilova et al., "Metallic Corrosion Inhibitors", Pegamon Press, New York, P. 79.

*Primary Examiner*—P. E. Willis, Jr.
*Attorney, Agent, or Firm*—Charles L. Harness

[57] ABSTRACT

The invention disclosed is directed to liquid detergent-germicide compositions which include an antimicrobial active phenolic derivative in combination with hydroxyacetic acid and a detergent. The present compositions are found to have significant antimicrobial activity in water, even with low concentrations of the phenolic derivative, a low skin irritation factor, and good color stability without any substantial degree of darkening under conditions of light and heat which typically convert phenolic containing disinfectants to a dark color.

10 Claims, No Drawings

DETERGENT-GERMICIDE COMPOSITIONS

This is a continuation-in-part of Ser. No. 630,868 filed Nov. 11, 1975, now abandoned, which is a continuation of Ser. No. 485,184 filed July 2, 1974, now abandoned, which is a continuation of Ser. No. 11328 filed Feb. 13, 1970, now abandoned.

This invention relates to liquid detergent-germicide compositions which include an antimicrobial active phenolic derivative in combination with hydroxyacetic acid and a detergent. The present detergent-germicide compounds are found to have significant activity in water, even with low concentrations of the antimicrobial phenolic derivative, a low skin irritation factor, and good color stability without any substantial degree of darkening under conditions of light and heat which typically convert phenolic containing disinfectants to a dark color.

Many disinfectant compositions are now well-known to the art with a great majority comprising aqueous solutions or emulsions of phenolic derivatives. However, these known disinfectants suffer from a variety of disadvantages, among which is selective action against certain organisms, reduction in efficiency by organic matter or specific inhibitor, high toxicity, corrosive and irritation action on the skin or mucous membrane, and extreme darkening under changes of light and heat conditions. It has now been found that by the practice of the present invention, a low cost acid (hydroxyacetic acid) may be combined with an antimicrobial active phenolic derivative in preparing a detergent-germicide composition having significant antimicrobial activity in water, a low skin irritation factor, and good color stability without any substantial degree of darkening under conditions of light and heat which typically convert phenolic containing disinfectants to a dark color. The present compositions are also found to be useful for commercial, industrial and general use where wide spectrum antimicrobial activity is required along with detergency action. These compositions may be prepared as a liquid concentrate which is readily diluted for use.

The present invention is based on the substitution of hydroxyacetic acid for a substantial portion of more costly antimicrobial active phenolic derivatives in preparing a detergent-germicide composition having significant broad spectrum antimicrobial activity in water, a low skin irritation factor, low toxicity, and good color stability in comparison to phenolic disinfectants conventionally known to the art.

Broadly stated, the liquid detergent-germicide compositions of the present invention include, in combination, a detergent which is preferably biodegradable, an antimicrobial active phenolic derivative and hydroxyacetic acid. The hydroxyacetic acid component of the present composition appears to enhance the antimicrobial activity as well as the color stability of the composition. These concentrate compositions are clear stable liquids which form effective detergent-germicide solutions on dilution with water. The compositions are also stable to temperature changes, thus resisting the tendency of the phenolic derivative to precipitate when subjected to freezing.

The compositions of the present invention may be found to be highly effective against common microorganisms such as *Staphylococcus aureus, Streptococcus pyogenes* and *Pseudomonas pyocyaneus* among others as well as against *Mycobacterium tuberculosis, Trichophyton interdigitale* and pathogenic fungi. It is recognized, however, that the effectiveness of the present composition depends upon the particular combination of materials, the concentration of ingredients used and the nature of the particular microorganism.

The concentrate detergent-germicide composition of this invention may contain from about 1 to about 36 parts by weight, anhydrous basis, of hydroxyacetic acid as a first component; from about 2.4 to about 30 parts by weight of an antimicrobial active phenolic derivative as a second component; and as a third component, from about 2 to about 30 parts by weight of a detergent which is preferably biodegradable. Preferably, the present concentrate detergent-germicide composition includes about 3 to about 18 parts by weight of the acid component, about 5 to about 15 parts by weight of the phenolic component, and about 5 to about 15 parts by weight of the detergent component. Concentrate forms of the present composition may have a pH of from about pH2 to about pH4. In normal use dilutions wherein the active phenolic derivative comprises about 0.02 to about 0.25 percent by weight, based on total weight, the pH may range from about pH3 to about pH5.

As stated, one component of the present composition is hydroxyacetic acid.

A second component forming the concentrate detergent-germicide of this invention is a phenolic derivative having antimicrobial activity. Phenolic derivatives found useful in the present detergent-germicide include o-phenylphenol; o o-benzyl-p-chlorophenol, o-cyclopentyl-p-chlorophenol; 4-chloro-2-phenylphenol, 6-chloro-2-phenylphenol and mixtures thereof; p-tertiary-amylphenol; p-tertiary-butylphenol; 2,2'-methylene-bis-(2,4,6-trichlorophenol); p-chloro-m-xylenol; dichloro-m-xylenol and the like. A considerable number of additional phenolic derivatives having antimicrobial activity may also be found useful in the present concentrate including those having free phenols and/or the alkali metal salts.

A third principal component of the present concentrate detergent-germicide composition is a surface active agent or detergent preferably biodegradable.

A great number of the detergents useful in the present invention are listed in McCutcheon's Detergents and Emulsifiers 1966 Annual (John W. McCutcheon Inc., Morristown, N.J., 1966).

Especially preferred detergents used in the practice of the present invention are the ammonium, alkylolamine, and/or sodium salts of sulfated ethoxylated coconut fatty alcohol (Steol CS 460 by Stepan Chemical Co.) or of sulfated ethoxylated linear secondary alcohols (Tergitol 15-S-3A and Tergitol 15-S-3S by Union Carbide Corporation) containing an average of about 3 ethoxy groups.

One class of surface active agents or detergents found useful in the present concentrate detergent-germicide composition is the sulfated, or phosphated ethoxylated primary or secondary alcohols most conveniently represented by the general formula:

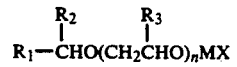

$$R_1-\overset{R_2}{\overset{|}{C}}HO(CH_2\overset{R_3}{\overset{|}{C}}HO)_nMX$$

where:

M is sulfate (i.e., $SO_3$) or phosphate;

$R_1$ is a hydrocarbon alkyl group containing 1 to about 20 carbon atoms;

$R_2$ is hydrogen or a hydrocarbon alkyl group containing 1 to about 20 carbon atoms;

The sum of carbon atoms in $R_1$ and $R_2$ is not greater than about 20;

$R_3$ is hydrogen or methyl;

n is a positive number having an average value of from 0.5 to about 20; and

X is hydrogen, alkali metal, ammonium or alkylolamine, e.g., triethanolamine.

Preferably $R_3$ is hydrogen, and n has an average value of from about 1 to about 9.

It is also preferred that the $R_1R_2CHO$-moiety contain from about 9 to about 15 total carbon atoms. $R_1$ and $R_2$ may be either straight or branched chain or a mixture of both. Preferably $R_1$ is linear and, when $R_2$ is alkyl it is also preferably linear.

Additional detergents which may be used in the present composition include fatty acid ethoxylate sulfates, sulfonates, phosphates or phosphonates. These various detergents including those previously listed and their equivalents such as where the $R_1R_2CHO$- moiety is replaced by an alkylphenoxy radical may be used herein as desired.

In general the surface active agents used in the practice of the present invention are knowr to the art. They may be prepared from raw materials from a number of sources and by a variety of methods. The $R_1R_2CHO$-moiety defined previously may be obtained from vegetable sources or prepared by one or more synthetic processes. It is recognized that this alcohol, prepared by a synthetic process, will vary in composition and may contain linear primary alcohols, linear secondary alcohols, branched chain primary alcohols and branched chain secondary alcohols. In addition to these species, it is recognized that the chain length will vary from much less to much more than the preferred chain length. However, the average chain length will fall in the preferred range and the desired species should predominate in such mixtures.

A convenient method for preparing detergents is by the reaction of an alcohol with ethylene or propylene oxide. This reaction does not give exact chain lengths and it is recognized that such reaction products will be mixtures with respect to the ether chain length, but the average chain length will fall within the preferred range. Sulfation or phosphation of this material results in an acidic product that may be neutralized with a metal hydroxide, ammonia or an amine.

The detergent component appears to minimize the deactivation effect on the phenolic derivative which may occur in the presence of an ethoxylated compound.

It is known that low molecular weight primary or secondary alcohols are frequently used as solvents in the manufacture of detergents.

Diluents or solvents (so-called "coupling agents") may form a component of the present concentrate detergent-disinfectant compositions if desired. Examples of known diluents or solvents include triethanolamine; and alcohols such as ethanol, isopropanol and hexylene glycol (2-methyl-2,4 pentanediol) which appear to serve as coupling agents. When added, these materials may be present in the concentrate detergent-disinfectant compositions in an amount from about 5 to about 20 parts by weight with amounts in the range from about 7 to about 15 parts by weight being preferred. It is generally found that addition of a water-miscible, or partially water-miscible alcohol to the present concentrate aids the solubility of the phenolic derivative.

Corrosion retardants may also be included in the present composition, if desired, which limit the effects on metallic surfaces of the acidic component. Useful materials include, for example, thiourea and the like which may be added to the concentrate in effective amounts up to about 8 parts by weight. Desirably, a corrosion retardant is added in an amount from about 0.5 to about 6 parts by weight and desirably between about 1 part to about 3 parts is found to be sufficient. The concentration of the corrosion retardant in the solution is about 0.002%. A thiourea concentration of about 70 to 80 ppm is found to inhibit corrosive effects of hydroxyacetic acid when such formulations are applied against galvanized steel.

Component odor masking ingredients or perfumes may be employed as a component of the present detergent-germicide if desired. Useful materials include camphor, neutroleum alpha or the like in effective amounts up to about 0.2 parts by weight of the concentrated formulation. Typically, amounts of masking ingredients between about 0.1 to about 1.5 parts by weight of the concentrated formulation are sufficient with an amount in the range of about 0.3 to about 0.7 being preferred.

The concentrate detergent-disinfectant compositions containing components in amounts set forth, may be diluted to produce antimicrobial treating compositions having as low as 0.02 percent by weight of the phenolic derivative without destroying the effectiveness thereof. In the usual formulation, the use dilution may include about 0.04 percent by weight of phenolic derivative, about 0.05 percent by weight of hydroxyacetic acid, and about 0.04 percent by weight of detergent. When added, the diluent may be present in an amount of about 0.04 percent and the perfume or masking agent may appear in effective amounts down to about 0.002 percent by weight of the total dilution. The corrosion retardant may appear in amounts previously indicated.

The invention is more fully illustrated by the following examples.

EXAMPLE 1

The following ingredients in amounts indicated were combined by mixing to form a detergent-germicide composition.

| Ingredients | Parts by Weight |
|---|---|
| Sodium salt of coconut fatty alcohol ether sulfate | 10 |
| o-Benzyl-p-chlorophenol | 6 |
| p-tertiary-Amylphenol | 3 |
| o-Phenylphenol | 0.5 |
| Isopropanol | 15 |
| Thiourea | 2 |
| Hydroxyacetic acid | 4.2 |
| Triethanolamine | 0.5 |
| Camphor fractions | 0.5 |
| Tap water | 59 |

EXAMPLE 2

The following ingredients in amounts indicated were combined by mixing to form a detergent-germicide composition.

| Ingredients | Parts by Weight |
|---|---|
| Sodium salt of coconut fatty alcohol ether sulfate | 8 |
| 4-chloro-2-phenylphenol and 6-chloro-2-phenylphenol (a commercial o-phenyl-p-chlorophenol containing some 6-chloro isomer) | 4 |
| p-tertiary-Amylphenol | 3 |
| Isopropanol | 10 |
| Hexylene glycol | 5 |
| Thiourea | 2 |
| Hydroxyacetic acid | 3 |
| Camphor | 0.2 |
| Tap water | 65 |

EXAMPLE 3

The following ingredients in amounts indicated were combined by mixing to form a detergent-germicide composition.

| Ingredients | Parts by Weight |
|---|---|
| Alfonic 1014-S (A sodium salt of ethylene oxide adducts of straight chain fatty alcohols by Continental Oil Co.) (60%) | 16 |
| p-tertiary-Amylphenol | 3 |
| o-Benzyl-p-chlorophenol (75%) | 6.5 |
| Isopropanol | 12 |
| Thiourea | 2 |
| Hydroxyacetic acid | 6 |
| Camphor | 0.2 |
| Tap water | 54 |

The following observations were made for the prepared composition.

| Determination | Observation |
|---|---|
| Stability for 3 months | |
| at room temperature | OK |
| at 5° C. | OK |
| at 50° C. | OK |
| pH of concentrate | 2.3 |
| pH of 1:256 deionized water dilution | 3.4 |
| clarity of 1:256 dilution in 300 ppm tap water | Very slight haze |
| densiry | 8.409 lbs/gal. |

EXAMPLE 4

The procedure of Example 3 was repeated, except 8.5 parts by weight of 75% o-benzyl-p-chlorophenol was added. Similar stability was observed at room temperature, at 5° C. and at 50° C. The pH of the concentrate was 2.3 and when diluted with deionized water at 1:256 dilution was 3.4. The clarity in 300 ppm hard water was comparable and the density was 8.445 lbs/gal.

The above compositions were clear, stable, liquid compositions and formed stable solutions on dilutions with water.

Examples 5–7 are especially preferred embodiments of the invention. Their respective compositions are given as follows.

| | % by Weight | | |
|---|---|---|---|
| | Ex. 5 | Ex. 6 | Ex. 7 |
| Sodium alkoxyethoxysulfate[1/] | 9.60 | 9.60 | 9.60 |
| Hydroxyacetic acid | 12.60 | 12.60 | 12.60 |

-continued

| | % by Weight | | |
|---|---|---|---|
| | Ex. 5 | Ex. 6 | Ex. 7 |
| o-benzyl-p-chlorophenol | 6.38 | 6.38 | 6.38 |
| p-tert-amylphenol | 3.00 | 3.00 | 3.00 |
| o-Phenylphenol | 0.50 | 0.50 | 0.50 |
| Isopropanol | 12.00 | — | 8.00 |
| Hexylene glycol | — | 10.00 | 4.00 |
| Triethanolamine | 1.00 | 1.00 | 1.00 |
| Perfume[2/] | 0.50 | 0.50 | 0.50 |
| Water | 54.42 | 56.42 | 54.42 |

[1/] $RO(CH_2CH_2O)_nSO_3Na$, where R is a mixture of hydrocarbon alkyl groups with an average of 13.5 carbon atoms and a range of 12 to 15 carbon atoms and n has a range of 0 to 5 with an average of 1

[2/] A mixture comprising methyl salicylate as the major ingredient

It is understood that the foregoing detailed description is given merely by way of illustration and that many variations may be made therein without departing from the spirit of this invention.

We claim:

1. A detergent germicide composition which consists essentially of from about 2.4 to about 30 parts by weight of an antimicrobial active phenolic derivative in combination with from about 1 to about 36 parts by weight of hydroxyacetic acid; and from about 2 to about 30 parts by weight of a detergent surfactant; said antimicrobial active phenolic derivative being selected from the group consisting of o-phenylphenol, o-benzyl-p-chlorophenol, o-cyclopentyl-p-chlorophenol, 4-chloro-2-phenylphenol, 6-chloro-2-phenylphenol, p-tertiary-amylphenol, p-tertiary-butylphenol, 2,2-methylene-bis-(2,4,6-trichlorophenol), p-chloro-m-xylenol, and dichlorom-xylenol; said detergent surfactant being represented by the general formula:

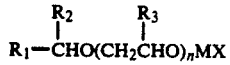

where:

M is sulfate or phosphate;

$R_1$ is a hydrocarbon alkyl group containing 1 to about 20 carbon atoms;

$R_2$ is hydrogen or a hydrocarbon alkyl group containing 1 to about 20 carbon atoms;

The sum of carbon atoms in $R_1$ and $R_2$ is not greater than about 20;

$R_3$ is hydrogen or methyl;

n is a positive number having an average value of from 0.5 to about 20; and

X is hydrogen, alkali metal, ammonium, or triethanolamine.

2. The composition of claim 1 wherein the pH of the composition is from about pH2 to about pH4.

3. The composition of claim 1 wherein the hydroxyacetic acid component is present in an amount from about 3 to about 18 parts by weight, the phenolic component is present in an amount from about 5 to about 15 parts by weight, and the detergent is present in an amount from about 5 to about 15 parts by weight.

4. The composition of claim 1 wherein the $R_1R_2CHO$-moiety contains about 9 to about 15 total carbon atoms.

5. The composition of claim 1 wherein a diluent selected from the group consisting of triethanolamine, ethanol, isopropanol and hexylene glycol (2-methyl-2,4-pentanediol) is included in an amount from about 5 to about 20 parts by weight.

6. The composition of claim 5 wherein the diluent is included in an amount from about 7 to about 15 parts by weight.

7. The composition of claim 1 in combination with water in an amount sufficient to provide a concentration of the phenolic component of about 0.02 to about 0.25 percent by weight.

8. The composition of claim 1 wherein thiourea is present as a corrosion retardant in an amount from about 0.5 to about 6 parts by weight.

9. The composition of claim 1 wherein thiourea is present as a corrosion retardant in an amount from about 1 to about 3 parts by weight.

10. The composition of claim 1 wherein a perfume is present in an amount between about 0.3 to about 0.7 parts by weight.

* * * * *

UNITED STATES PATENT AND TRADEMARK OFFICE

CERTIFICATE OF CORRECTION

PATENT NO. : 4,157,977

DATED : June 12, 1979

INVENTOR(S) : Norman E. Dewar, et al.

It is certified that error appears in the above-identified patent and that said Letters Patent are hereby corrected as shown below:

On the cover sheet delete

"[*] Notice: The portion of the term of this patent subsequent to Nov. 3, 1987, has been disclaimed."

Signed and Sealed this

*Twenty-eighth* Day of *August 1979*

[SEAL]

*Attest:*

*Attesting Officer*

LUTRELLE F. PARKER

*Acting Commissioner of Patents and Trademarks*